US006257672B1

(12) United States Patent
Parrott

(10) Patent No.: US 6,257,672 B1
(45) **Date of Patent: *Jul. 10, 2001**

(54) CLIP FOR RETAINING A WATER SPRAY NOZZLE WITHIN A PICK BOX OF A CUTTING HEAD

(75) Inventor: George Albert Parrott, Barnsley (GB)

(73) Assignee: Minnovation Limited (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/119,544

(22) Filed: Jul. 20, 1998

(30) Foreign Application Priority Data

Aug. 22, 1997 (GB) ..... 9717830

(51) Int. Cl.[7] ..... E21C 35/187
(52) U.S. Cl. ..... 299/81.3; 239/600
(58) Field of Search ..... 299/107, 81.1, 299/81.3; 175/424; 239/DIG. 8, 600; D8/394, 395, 396; 403/315, 316, 317, 326; 24/563, 30.55

(56) References Cited

U.S. PATENT DOCUMENTS

| | | | | |
|---|---|---|---|---|
| D. 32,580 | * | 4/1900 | Moule | 254/334 |
| D. 306,553 | * | 3/1990 | Rumpel | 220/324 |
| 4,113,397 | * | 9/1978 | Snyder | 403/154 |
| 4,555,143 | | 11/1985 | Wrulich et al. . | |
| 4,694,542 | * | 9/1987 | Koppe | 24/30.5 S |
| 4,998,875 | * | 3/1991 | Starkey | 425/577 |
| 5,195,805 | | 3/1993 | Clapham . | |
| 5,378,048 | * | 1/1995 | Parrot | 299/81.1 |
| 5,456,552 | * | 10/1995 | Cherrington | 175/424 X |
| 5,529,384 | * | 6/1996 | Ojanen et al. | 299/107 |

FOREIGN PATENT DOCUMENTS

| | | | |
|---|---|---|---|
| 2282298 | * | 3/1976 | (FR) . |
| 1571371 | | 7/1980 | (GB) . |
| 2054007 | * | 2/1981 | (GB) . |
| 0041663 | | 12/1981 | (WO) . |
| 0264010 | * | 9/1987 | (WO) . |

* cited by examiner

*Primary Examiner*—Eileen D. Lillis
*Assistant Examiner*—Sunil Singh
(74) *Attorney, Agent, or Firm*—Trexler, Bushnell, Giangiorgi, Blackstone & Marr, Ltd.

(57) ABSTRACT

A push-in, prise-out, clip (1) for releasably retaining a replaceable water spray nozzle (2) in a receiving bore (3), comprises a plate-like member of suitable resilient material, generally of "V" or "U"-shape having "C"-shaped recess (6) subtending an arc greater than 180° and adapted, in use, to engage a correspondingly arcuate waist portion (7) of the water spray nozzle (2). The recess (6) is defined in part by arcuate profiles (8) on mutually facing, inner surfaces (9) of each arm (10) of the "V" or "U", which arms (10) are adapted to splay apart resiliently during the fitting and the removal of a clip on the water spray nozzle (2), whilst a portion of the clip (1) is provided with a clip retraction surface (12). The invention also includes a water spray nozzle (2), a pick box (4), and a rotary mineral cutting head (36).

10 Claims, 3 Drawing Sheets

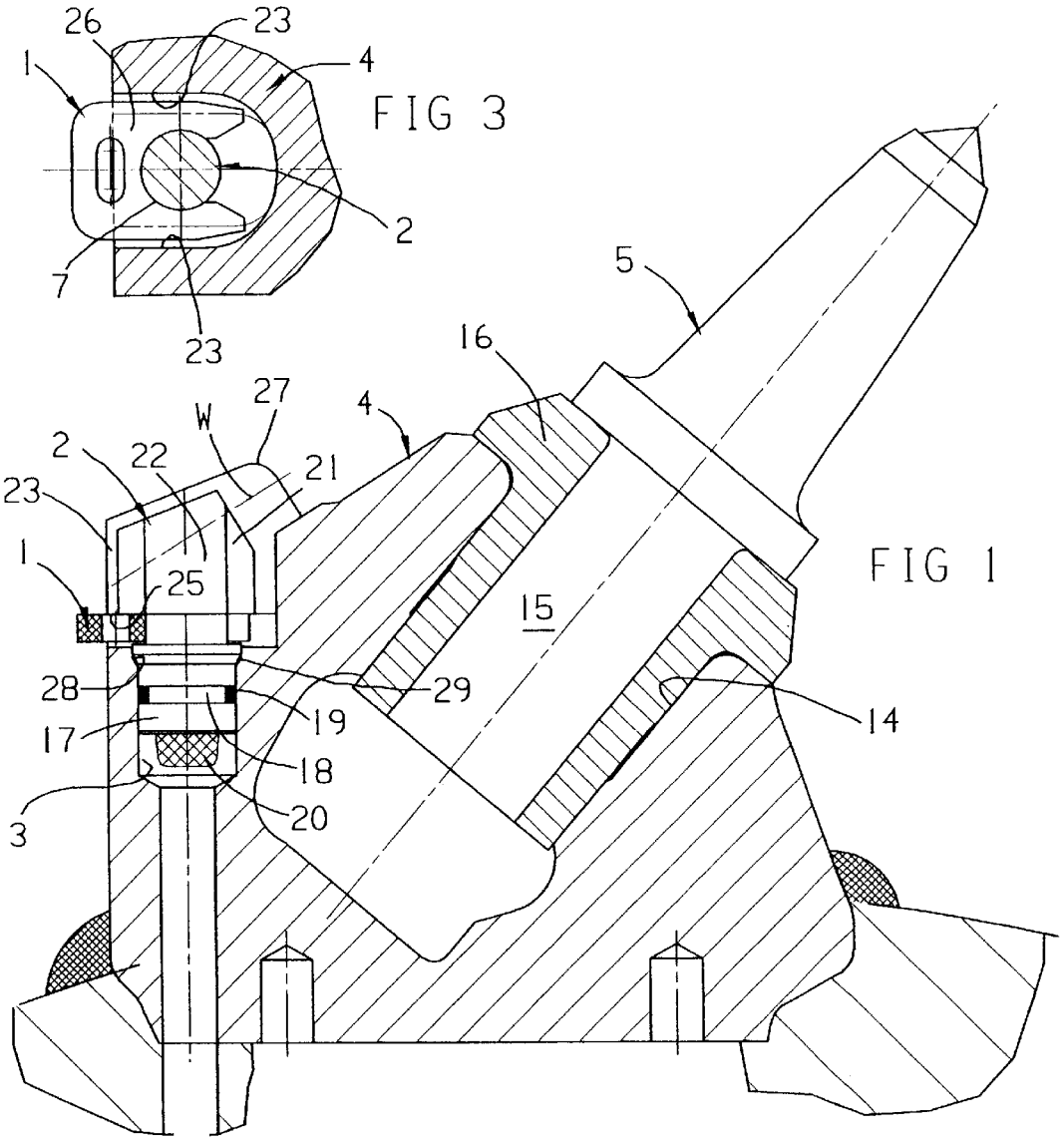
FIG 1
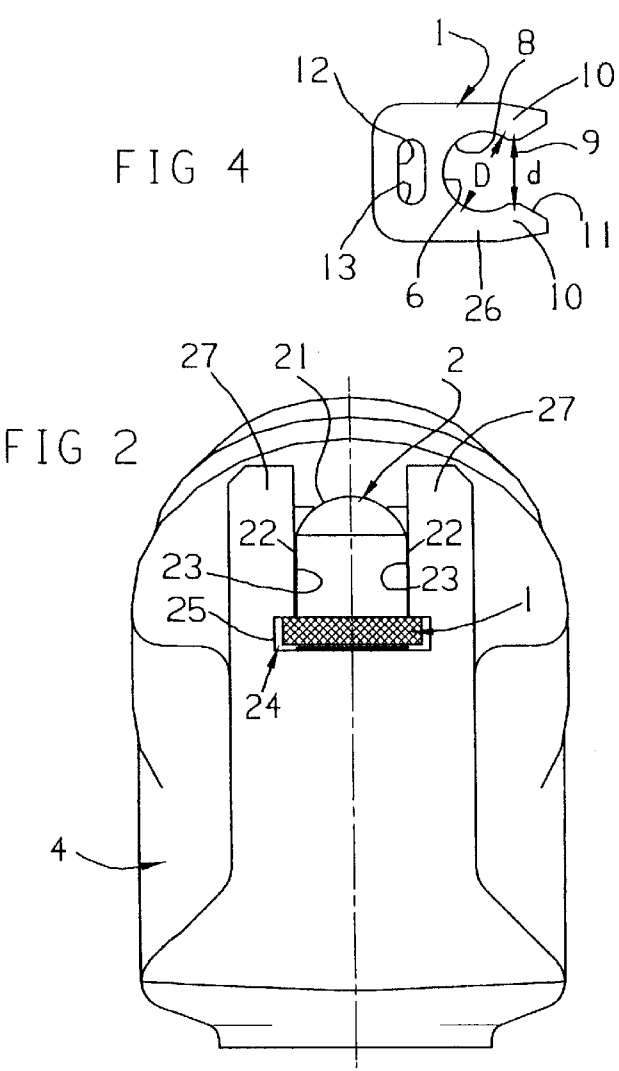
FIG 2
FIG 3
FIG 4

CLIP FOR RETAINING A WATER SPRAY NOZZLE WITHIN A PICK BOX OF A CUTTING HEAD

This invention relates to various items of mining related equipment, specifically a clip, a water spray nozzle, a pick box, and a rotary cutting head.

BACKGROUND OF THE INVENTION

1. Field of the Invention

Water spray nozzles have been used in a variety of dust and ignition suppression operations. For instance water spray nozzles have been provided in, on, or adjacent pick boxes for a variety of purposes. In coal mining such purposes are dust suppression; pre-start warning; incendive sparking suppression shrouding, and, on a so-called ventilated rotary cutting head, for air flow inducement to encourage methane dilution and dispersal. In coal transportation, such uses are on belt conveyor spray bars, chutes, and lump breakers.

2. Description of the Prior Art

In mining conditions, whether mining coal, potash or other minerals, or in tunnel driving operations, there is a propensity for nozzle blockage, particularly when a machine is idle for whatever reason. Hence removal, cleaning and refitting is essential if the nozzles are to remain effective, particularly as some machines safety systems monitor water flow and/or pressure and effect machine shut down automatically when monitored parameters signal excessive blockage. Various attempts, successful to greater or lesser extents, have been made to provide "screwless" nozzles, to overcome the known drawbacks of removing and refitting screw-in, screw-out nozzles in mine conditions. Thus, metal pins, wires and staples have been proposed. As a typical coal winning drum would typically carry some 50–70 pick boxes, nozzle removal, cleaning and replacement is a tedious and time consuming operation in the limited confines and lighting of a coal face. There is a demand for an attachment system that is both simple and rapid.

OBJECT OF THE INVENTION

A basic object of the invention is to provide an improved clip, a water spray nozzle, a pick box, and a rotary cutting head.

SUMMARY OF THE INVENTION

According to a first aspect of the invention there is provided a push-in, prise-out, clip for releasably retaining a replaceable water spray nozzle in a receiving bore, the clip comprising a plate-like member of suitable resilient material, e.g. synthetic plastics material, spring steel etc., generally of "V" or "U"-shape having "C"-shaped recess subtending an arc greater than 180° and adapted, in use, to engage a correspondingly arcuate waist portion of the water spray nozzle, the recess being defined in part by arcuate profiles on mutually facing, inner surfaces of each arm of the "V" or "U", which arms are adapted to splay apart resiliently during the fitting and the removal of a clip on the water spray nozzle, with each arm provided with a mutually inclined surface to aid fitting, with the distance between inner ends of the inclined surfaces, in a non-splayed condition, being less than the diameter of the "C"-shaped recess, and with a portion of the clip in the base of the "V" or "U", being provided with a clip retraction surface.

Thus, to fit and to remove a clip in accordance with the first aspect of the invention from a nozzle, the clip needs to be displaced radially with respect to the nozzle. During fitting the radial displacement force must exceed that needed to splay the arms. This may be achieved by manually pushing the clip into place, or by tapping the clip into place by a simple tool such as a hammer, with retraction by another simple tool such as a screwdriver blade.

Preferably, the clip retraction surface is provided by a wall of a slot or bore in the clip, engageable by a simple tool such as a screwdriver bit, to achieve clip retraction by prising out the clip to splay the arms apart, so as to permit nozzle removal.

According to a second aspect of the present invention of independent significance, there is provided a water spray nozzle, adapted to be received, releasably, in a bore, the nozzle comprising:

(1) a spigot portion of diameter approximating to that of its intended receiving bore;

(2) a water conveying passage extending through the spigot portion from an open, inlet end of the nozzle;

(3) a first circumferential groove located adjacent the water inlet end of the spigot portion to carry a resilient sealing ring to sealingly engage a portion of the bore;

(4) a waist defined by a second circumferential groove located downstream of the first circumferential groove and adapted, in use, to be engageable by a clip in accordance with the first aspect;

(5) a head portion of the nozzle located downstream of the waist and intended, in use, to be external to the bore; and (6) a water discharge aperture provided in the head portion.

In one embodiment, the receiving bore, may be provided in a pick box, such bore being in fluid flow communication with a port of a water supply network.

In another embodiment, the receiving bore may be provided in a housing adapted to be welded eg into a recess in a vane of a rotary cutting head, with the bore again being in fluid flow communication with a water supply network eg of an associated vane of a rotary cutting head. Clearly, the housing needs to be welded in an orientation to provide water discharge in the required direction eg towards the tip of an adjacent mineral cutter pick.

In one embodiment, the nozzle provides for water discharge in a predetermined radial direction by having at least one flat on the head portion, and preferably provided with a pair of opposed, parallel flats on its head portion, for engagement, eg when fitted to a pick box, with a corresponding flat to ensure the required nozzle orientation and hence that of its discharge aperture. Such an embodiment is suitable for fitting into a receiving bore of a pick box, and preferably the head is enlarged or circumferentially grooved so that, to remove a nozzle, a simple tool such as a screwdriver blade is engageable beneath the enlarged head to prise the nozzle from its bore.

In another embodiment, the nozzle may provide for co-axial water discharge in the required pattern, e.g. as a solid cone, hollow cone or pencil jet.

With all embodiments of nozzle, the inlet end of the water conveying passage is peferably covered by a debris filtration gauze. Also, any water receiving chamber in an enlarged head is preferably provided with a water swirl unit, if swirled water emission, in contrast to a generally coherent jet of water, is required.

According to a third aspect of the invention of independent significance, there is provided a pick box in combination with a clip in accordance with the first aspect and a nozzle in accordance with the second aspect, the pick box comprising (i) a bore adapted to receive the spigot portion of the nozzle, (ii) at least one flat to be engaged by a nozzle flat(s), and (iii) an aperture to receive the clip, the aperture providing an abutment surface adapted to be engaged by a portion of a surface of the clip when pushed into its aperture and engaging the circumferential groove of the nozzle, which engagement prevents inadvertent nozzle removal.

Preferably, the box is provided with a pair of spaced apart flanges, extending beyond the upper end of the bore and beyond the axial length of the head portion, not only to provide damage protection for the otherwise exposed head portion from the mineral being mined, but also with opposed, parallel faces of flanges providing two flats for engagement by the preferred two flats of the nozzle head.

Preferably, the clip receiving aperture is a slot, of width slightly exceeding the thickness of the clip, provided at innermost ends of the flanges and intersecting each flange to provide an abutment surface in each flange that is orthogonal to the parallel flats of the pick box.

The spigot receiving bore is preferably provided with a frusto-conical mouth, adapted to be engaged by a frusto-conical seating surface of the nozzle at a transition portion between the spigot and the head of the nozzle. The latter may be of unitary construction.

According to a fourth aspect of the invention, of independent significance, there is provided a rotary mineral cutting head provided with a plurality of nozzles in accordance with the first aspect, and pick boxes in accordance with the second aspect.

BRIEF DESCRIPTION OF THE DRAWINGS

Examples of clip, nozzle and pick box in accordance with the three aspects of the invention are shown in the accompanying drawings in which:

FIG. 1 is a sectional view through the clip, a first embodiment of spray nozzle, pick box and rotary cutting head of the first, second, third and fourth aspects of the invention;

FIG. 2 is a rear elevation of the pick box of FIG. 1;

FIG. 3 is a part sectional plan view of a portion of FIG. 1;

FIG. 4 is a plan view of the clip of the first aspect, before insertion,

DETAILED DESCRIPTION OF THE DRAWINGS

Figure 7:
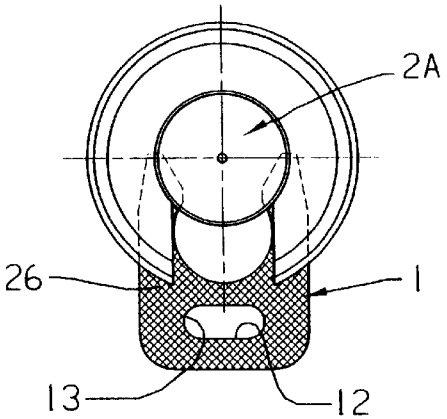
FIGS. 7 and 8 are plan views of the nozzle of FIG. 5 and housing of FIG. 6, with the clip about to be fitted, and fully fitted, respectively.
Figure 8:
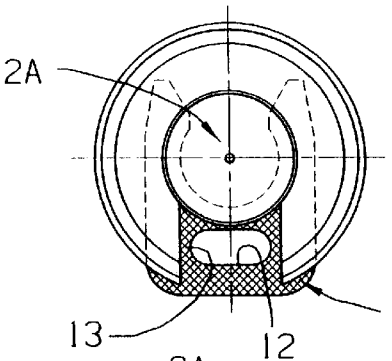
Figure 9:
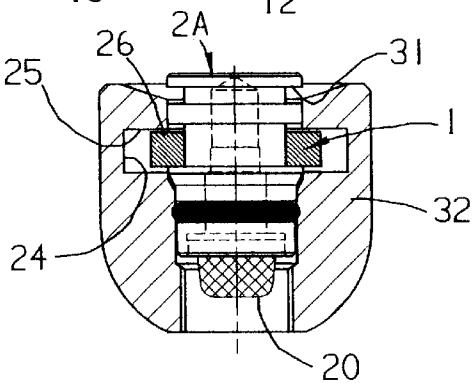
FIG. 9 is a sectional view through the nozzle of FIG. 6 housing the nozzle of FIG. 5 retained by the clip of FIG. 4.

A push-in, prise-out, clip 1 is, in the embodiment of FIGS. 1 and 2, for releasably retaining a replaceable water spray nozzle 2 in a receiving bore 3 which, in the embodiment of FIGS. 1–3, is provided in a pick box 4 itself adapted to receive a replaceable mineral cutter pick 5.

The clip 1 comprises a plate-like member of suitable resilient material, e.g. synthetic plastics material, spring steel etc., generally of "V" or "U"-shape, having "C"-shaped recess 6 subtending in arc greater then 180° and adapted, in use, to engage a correspondingly arcuate and waisted portion 7 of the water spray nozzle 2. The recess 6 is defined in part by arcuate profiles 8 on mutually facing, inner surfaces 9, of each arm 10 of the "V" or "U", which arms 10 are adapted to splay apart resiliently during the fitting and removal of a clip 1 on a nozzle 2. For purposes of fitting, each arm 10 is provided with a mutually inclined surface 11, with the distance "d" between inner ends of the inclined surfaces, in a non-splayed condition, being less than the diameter "D" of the "C"-shaped recess 6. A portion of the clip 1 in the base of the "V" or "U", is provided with a clip retraction surface in the form of a wall 12 of a slot 13 in the clip, engageable by a simple tool such as a screwdriver bit, to achieve clip retraction by prising out the clip so as to permit removal of the nozzle 2 from its bore 3.

The water spray nozzle 2, the subject of the second aspect of the invention is adapted to be received, in part, in the bore 3 of the pick box 4 which is also adapted to receive, in an aperture 14, a shank portion 15 of the cutter pick 5, with an interposed sleeve 16. In detail, the nozzle 2 comprises a spigot portion 17 of diameter approximating to that of its intended receiving bore 3 and a circumferential groove 18 within the axial length "L" of the spigot portion 17 to carry a resilient sealing ring 19 to sealingly engage a portion of wall of the bore 3. A water conveying passage (not shown) extends through the spigot portion 17 from a lower, open inlet end of the nozzle, which end is covered by a debris filtration gauze 20. An enlarged head 21 of the nozzle 2 is located beyond the spigot portion 17 and, in use, is external to the bore 3. A water receiving chamber (not shown) is provided within the head 21 in fluid flow communication with an outlet end of the water conveying passage of the spigot portion 17, whilst a water discharge aperture (not shown) for discharge of water generally along axis "W" is provided in the head 21 and a pair of opposed, parallel flats 22 are provided on the head 21.

A pick box in accordance with the third aspect of the invention, in combination with a clip 1 and a nozzle 2, comprises, as best seen in FIG. 2, an inverted "T"-slot providing a pair of opposed, parallel flats 23 to be engaged by the nozzle flats 22 and an aperture 24 to receive the clip 1, the aperture providing an abutment surface 25 adapted to be engaged by a portion of a surface 26 of the clip 1 when pushed into its aperture 24 and engaging the circumferential groove 7 of the nozzle 2, which surface 25 to surface 26 engagement prevents inadvertent nozzle removal.

The box is also provided with a pair of spaced-apart flanges 27 extending beyond the upper end of the bore 3 and beyond the axial length of the head portion 21, not only to provide damage protection for the otherwise exposed head portion 21 from the mineral being mined, but also providing the flats 23.

As best seen in FIG. 2, the clip receiving aperture 24 is also a slot, of width slightly exceeding the thickness of the clip 1, provided at innermost ends of the flanges 27 and intersecting each flange to provide an abutment surface 25 in each flange 27, which surfaces 25 are orthogonal to the parallel flats 23.

The bore 3 is provided with a frusto-conical mouth 28 adapted to be engaged by a frusto-conical seating surface 29 of the nozzle 2 at a transition portion between the spigot portion 17 and the head portion 21 of the nozzle 2.

Figure 5:
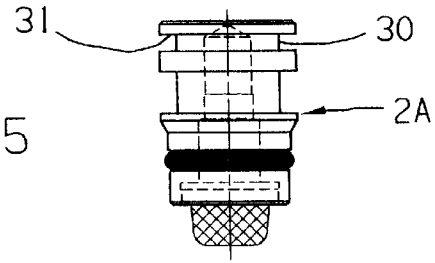
FIG. 5 is a side elevation of a second embodiment of nozzle.
Figure 6:
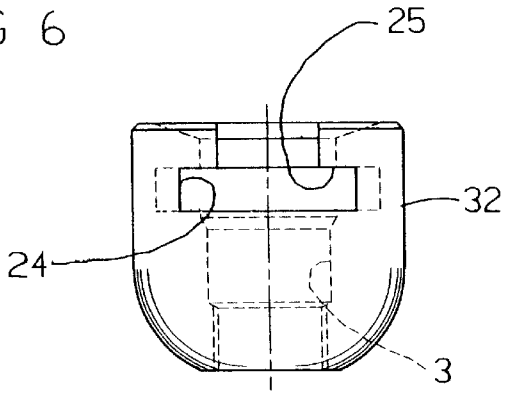
FIG. 6 is a side elevation of a housing adapted to receive the nozzle of FIG. 5.
Figure 11:
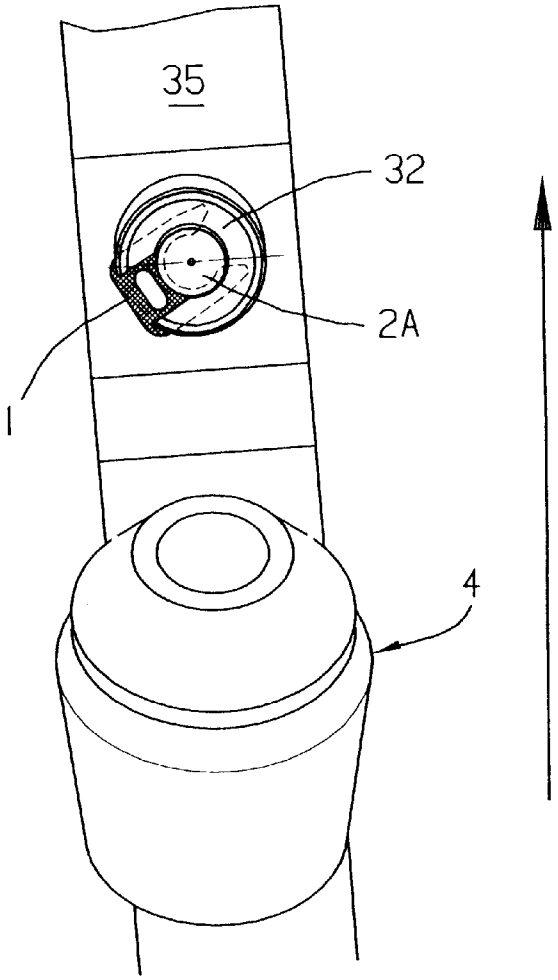
FIG. 11 is an end elevation on the vane etc., of FIG. 10.
Figure 10:
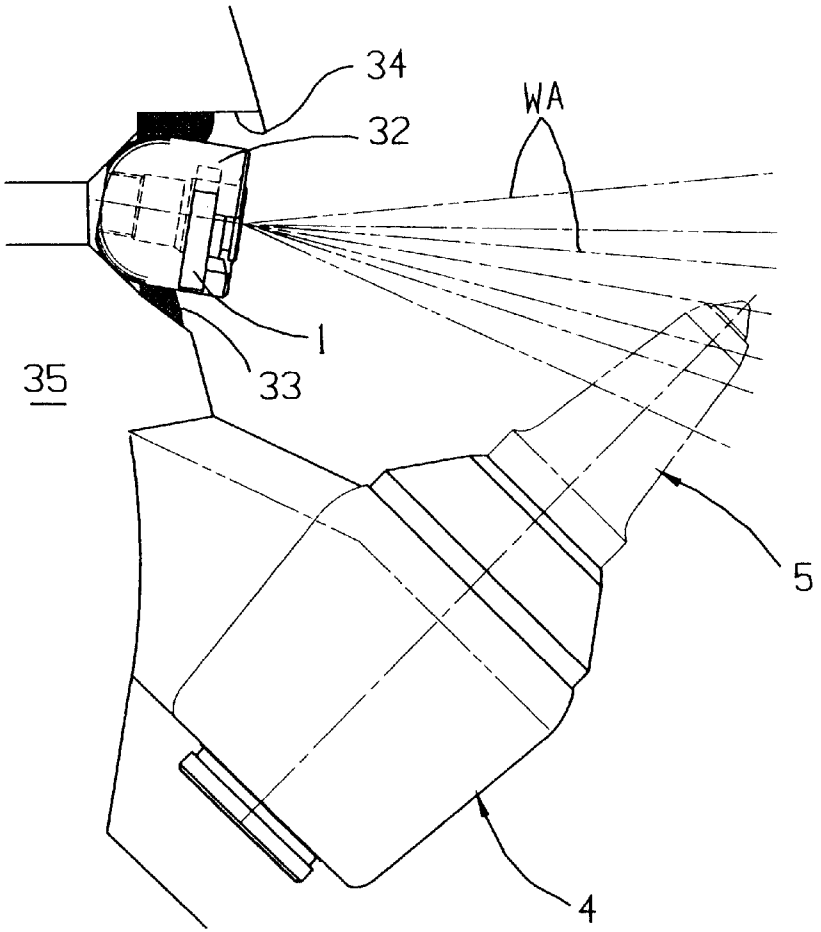
FIG. 10 is a side elevation of the combination of FIG. 9 welded into an aperture of a vane of a rotary cutting head.

In FIG. 5 is illustrated a second embodiment of nozzle 2A, adapted, in contrast to the nozzle 2, to emit a generally axial water spray WA. A circumferential groove 30 in the head 21A, so as to define a surface 31 engageable by a screwdriver blade for instance, to permit the nozzle 2A to be extracted from its receiving bore 3A provided in a housing 32 adapted to be secured by weld metal 33 in a recess 34 in a helical vane 35 provided on a rotary cutting head 36 of a mining machine.

What I claim is:

1. In combination a pick box, a clip and a water spray nozzle, a receiving bore for said nozzle being provided in said pick box, said clip being a push-in, prise-out clip for releasably retaining said nozzle in said receiving bore, said clip comprising a planar, plate-like member of suitable resilient material of non-circular section, generally of "U"-shape having a pair of spaced-apart arms extending forwardly from a base of said plate-like member, said base having a striking surface which is orthogonal to the arms, each arm having a parallel outer surface defining the width of said plate-like member, with a slot provided in a central portion of said base such that said arms extend to said striking surface, said arms further having "C"-shaped recess subtending an arc greater than 180° and adapted, in use, to clip onto a correspondingly arcuate waist portion of the water spray nozzle, said recess being defined in part by arcuately concave profiles on mutually facing, inner surfaces of each of said arms, which arms are adapted to splay apart, resiliently, in the plane of said clip, during the fitting of said clip on, and the removal of said clip from, said water spray nozzle, with each of said arms provided with a mutually inclined surface leading directly to said "C"-shaped recess to aid fitting, with the distance between inner ends of said inclined surfaces, in a non-splayed condition, being less than the diameter of said "C"-shaped recess said slot provided in said base engageable by a simple tool such as a screwdriver bit, to achieve clip retraction by prising out said clip to splay said arms apart, so as to permit removal of said nozzle from said receiving bore, said nozzle comprising a spigot portion of diameter approximating to that of said receiving bore; a water conveying passage extending through said spigot portion from an open, inlet end of said nozzle; a first circumferential groove located adjacent said water inlet end of said spigot portion to carry a resilient sealing ring to sealingly engage a portion of said receiving bore; said waist portion which is defined by a second circumferential groove located downstream of said first circumferential groove and adapted, in use, to be engageable by said clip; a head portion of said nozzle located downstream of said waist and intended, in use, to be external to said receiving bore; and a water discharge aperture provided in said head portion; and a housing comprising at least one flat to be engaged by a nozzle flat(s), and an aperture to receive said clip, said aperture providing an abutment surface adapted to be engaged by a portion of a surface of said clip when pushed into its aperture and engaging said second circumferential groove of said nozzle, which engagement prevents inadvertent nozzle removal.

2. The combination of claim 1, wherein said pick box is provided with a pair of spaced-apart flanges, extending beyond the upper end of said bore and beyond the axial length of said head portion, providing said flat and another flat, said flats being generally parallel.

3. The combination of claim 2, wherein said clip receiving aperture is a slot, of width slightly exceeding the thickness of said clip, provided at innermost ends of said spaced-apart flanges and intersecting each flange to provide said abutment surface in each flange that is orthogonal to said parallel flats of said pick box.

4. The combination of claim 1, wherein said spigot receiving bore is provided with a frusto-conical mouth, adapted to be engaged by a frusto-conical seating surface of the nozzle at a transition portion between said spigot and said head of said nozzle.

5. A rotary, mineral cutting head provided with a plurality of combinations, each of said combinations comprising a pick box, a clip and a water spray nozzle, a receiving bore for said nozzle being provided in said pick box, said clip being a push-in, prise-out clip for releasably retaining said nozzle in said receiving bore, said clip comprising a planar, plate-like member of suitable resilient material of non-circular section, generally of "U"-shape having a pair of spaced-apart arms extending forwardly from a base of said plate-like member, said base having a striking surface which is orthogonal to the arms, each arm having a parallel outer surface defining the width of said plate-like member, with a slot provided in a central portion of said base such that said arms extend to said striking surface, said arms further having "C"-shaped recess subtending an arc greater than 180° and adapted, in use, to clip onto a corresponding arcuate waist portion of the water spray nozzle, said recess being defined in part by arcuately concave profiles on mutually facing, inner surfaces of each of said arms, which arms are adapted to splay apart, resiliently, in the plane of said clip, during the fitting of said clip on, and the removal of said clip from, said water spray nozzle, with each of said arms provided with a mutually inclined surface leading directly to said "C"-shaped recess to aid fitting, with the distance between inner ends of said inclined surfaces, in a non-splayed condition, being less than the diameter of said "C"-shaped recess said slot provided in said base engageable by a simple tool such as a screwdriver bit, to achieve clip retraction by rising out said clip to splay said arms apart, so as to permit removal of said nozzle from said receiving bore, said nozzle comprising a spigot portion of diameter approximating to that of said receiving bore; a water conveying passage extending through said spigot portion from an open, inlet end of said nozzle; a first circumferential groove located adjacent said water inlet end of said spigot portion to carry a resilient sealing ring to sealingly engage a portion of said receiving bore; said waist portion defined by a second circumferential groove located downstream of said first circumferential groove and adapted, in use, to be engageable by said clip; a head portion of said nozzle located downstream of said waist portion and intended, in use, to be external to said receiving bore; and a water discharge aperture provided in said head portion; and a housing comprising at least one flat to be engaged by a nozzle flat(s), and an aperture to receive said clip, said aperture providing an abutment surface adapted to be engaged by a portion of a surface of said clip when pushed into its aperture and engaging said second circumferential groove of said nozzle, which engagement prevents inadvertent nozzle removal.

6. In combination a housing, a clip and a water spray nozzle, a receiving bore for said nozzle being provided in said housing, said clip being a push-in, prise-out clip for releasably retaining said nozzle in said receiving bore, said clip comprising a planar, plate-like member of suitable resilient material of non-circular section, generally of "U"-shape having a pair of spaced-apart arms extending forwardly from a base of said plate-like member, said base having a striking surface which is orthogonal to the arms, each arm having a parallel outer surface defining the width of said plate-like member, with a slot provided in a central portion of said base such that said arms extend to said striking surface, said arms further having "C"-shaped recess subtending an arc greater than 180° and adapted, in use, to clip onto a correspondingly arcuate waist portion of the water spray nozzle, said recess being defined in part by arcuately concave profiles on mutually facing, inner surfaces of each of said arms, which arms are adapted to splay apart, resiliently, in the plane of said clip, during the fitting of said clip on, and the removal of said clip from, said water spray nozzle, with each of said arms provided with a mutually inclined surface leading directly to said "C"-shaped recess to aid fitting, with the distance between inner ends of said inclined surfaces, in a non-splayed condition, being less than the diameter of said "C"-shaped recess said slot provided in said base engageable by a simple tool such as a screwdriver bit, to achieve clip retraction by prising out said clip to splay said arms apart, so as to permit removal of said nozzle from said receiving bore, said nozzle comprising a spigot portion of diameter approximating to that of said receiving bore; a water conveying passage extending through said spigot portion from an open, inlet end of said nozzle; a first circumferential groove located adjacent said water inlet end of said spigot portion to carry a resilient sealing ring to sealingly engage a portion of said receiving bore; said waist portion defined by a second circumferential groove located downstream of said first circumferential groove and adapted, in use, to be engageable by said clip; a head portion of said nozzle located downstream of said waist portion and intended, in use, to be external to said receiving bore; and a water discharge aperture provided in said head portion; and said housing comprising an aperture to receive said clip, said aperture providing an abutment surface adapted to be engaged by a portion of a surface of said clip when pushed into its aperture and engaging said second circumferential groove of said nozzle, which engagement prevents inadvertent nozzle removal.

7. A rotary, mineral cutting head provided with a plurality of combinations, each of said combinations comprising a housing, a clip and a water spray nozzle, a receiving bore for said nozzle being provided in said housing, said clip being a push-in, prise-out clip for releasably retaining said nozzle in said receiving bore, said clip comprising a planar, plate-like member of suitable resilient material of non-circular section, generally of "U"-shape having a pair of spaced-apart arms extending forwardly from a base of said plate-like member, said base having a striking surface which is orthogonal to the arms, each arm having a parallel outer surface defining the width of said plate-like member, with a slot provided in a central portion of said based such that said arms extend to said striking surface, said arms further having "C"-shaped recess subtending an arc greater than 180° and adapted, in use, to clip onto a correspondingly arcuate waist portion of the water spray nozzle, said recess being defined in part by arcuately concave profiles on mutually facing, inner surfaces of each of said arms, which arms are adapted to splay apart, resiliently, in the plane of said clip, during the fitting of said clip on, and the removal of said clip from, said water spray nozzle, with each of said arms provided with a mutually inclined surface leading directly to said "C"-shaped recess to aid fitting, with the distance between inner ends of said inclined surfaces, in a non-splayed condition, being less than the diameter of said "C"-shaped recess said slot provided in said base engageable by a simple tool such as a screwdriver bit, to achieve clip retraction by prising out said clip to splay said arms apart, so as to permit removal of said nozzle from said receiving bore, said nozzle comprising a spigot portion of diameter approximating to that of said receiving bore; a water conveying passage extending through said spigot portion from an open, inlet end of said nozzle; a first circumferential groove located adjacent said water inlet end of said spigot portion to carry a resilient sealing ring to sealingly engage a portion of said receiving bore; said waist portion defined by a second circumferential groove located downstream of said first circumferential groove and adapted, in use, to be engageable by said clip; a head portion of said nozzle located downstream of said waist portion and intended, in use, to be external to said receiving bore; and a water discharge aperture provided in said head portion; and said housing comprising an aperture to receive said clip, said aperture providing an abutment surface adapted to be engaged by a portion of a surface of said clip when pushed into its aperture and engaging said second circumferential groove of said nozzle, which engagement prevents inadvertent nozzle removal.

8. A push-in, prise-out, clip for releasably retaining a replaceable water spray nozzle in a receiving bore, said clip comprising a planar, plate-like member of suitable resilient material of non-circular section, generally of "U"-shape having a pair of spaced-apart arms extending forwardly from a base of said plate-like member, said base having a striking surface which is orthogonal to the arms, each arm having a parallel outer surface defining the width of said plate-like member with a slot provided in a central portion of said base, such that said arms extend to said striking surface, said arms further having "C"-shaped recess subtending an arc greater than 180° and adapted, in use, to clip onto a correspondingly arcuate waist portion of said water spray nozzle, said recess being defined in part by arcuately concave profiles on mutually facing, inner surfaces of each of said arms, which arms are adapted to splay apart, resiliently, in the plane of said clip, during the fitting of said clip on, and the removal of said clip from, said water spray nozzle, with each of said arms provided with a mutually inclined surface leading directly to said "C"-shaped recess to aid fitting, with the distance between inner ends of said inclined surfaces, in a non-splayed condition, being less than the diameter of said "C"-shaped recess, said slot provided in said base engageable by a simple tool such as a screwdriver bit to achieve clip retraction by prising out said clip to splay said arms apart, so as to permit removal of said nozzle from said receiving bore.

9. In combination a pick box, a clip and a water spray nozzle, a receiving bore for said nozzle being provided in said pick box, said clip being a push-in, prise-out clip for releasably retaining said nozzle in said receiving bore, said clip comprising a plate-like member of suitable resilient material of non-circular section, generally of "U"-shape having a pair of spaced-apart arms extending forwardly from a base of said plate-like member, said base having a striking surface which is orthogonal to the arms, each arm having a parallel outer surface defining the width of said plate-like member, with a slot provided in a central portion of said base such that said arms extend to said striking surface, said arms further having "C"-shaped recess subtending an arc greater than 180° and adapted, in use, to clip onto a correspondingly arcuate waist portion of the water spray nozzle, said recess being defined in part by arcuate profiles on mutually facing, inner surfaces of each of said arms, which arms are adapted to splay apart resiliently during the fitting and the removal of said clip onto and from, said water spray nozzle, with each of said arms provided with a mutually inclined surface to aid fitting, with the distance between inner ends of said inclined surfaces, in a non-splayed condition, being less than the diameter of said "C"-shaped recess and with a portion of said slot defining a clip retraction surface, said nozzle comprising a spigot portion of diameter approximating to that of said receiving bore; a water conveying passage extending through said spigot portion from an open, inlet end of said nozzle; a first circumferential groove located adjacent said water inlet end of said spigot portion to carry a resilient sealing ring to sealingly engage a portion of said receiving bore; said waist portion defined by a second circumferential groove located downstream of said first circumferential groove and adapted, in use, to be engageable by said clip; a head portion of said nozzle located downstream of said waist and intended, in use, to be external to said receiving bore; and a water discharge aperture provided in said head portion; and a housing comprising at least one flat to be engaged by a nozzle flat(s), and an aperture to receive said clip, said aperture providing an abutment surface adapted to be engaged by a portion of a surface of said clip when pushed into its aperture and engaging said second circumferential groove of said nozzle, which engagement prevents inadvertent nozzle removal, wherein said pick box is provided with a pair of spaced-apart flanges, extending beyond the upper end of said bore and beyond the axial length of said head portion, providing said flat and another flat, said flats being generally parallel, wherein said clip receiving aperture is a slot, of width slightly exceeding the thickness of said clip, provided at innermost ends of said spaced-apart flanges and intersecting each flange to provide said abutment surface in each flange that is orthogonal to said parallel flats of said pick box.

10. In combination a pick box, a clip and a water spray nozzle, a receiving bore for said nozzle being provided in said pick box, said clip being a push-in, prise-out clip for releasably retaining said nozzle in said receiving bore, said clip comprising a plate-like member of suitable resilient material of non-circular section, generally of "U"-shape having a pair of spaced-apart arms extending forwardly from a base of said plate-like member, said base having a striking surface which is orthogonal to the arms, each arm having a parallel outer surface defining the width of said plate-like member, with a slot provided in a central portion of said base such that said arms extend to said striking surface, said arms further having "C"-shaped recess subtending an arc greater than 180° and adapted, in use, to clip onto a correspondingly arcuate waist portion of the water spray nozzle, said recess being defined in part by arcuate profiles on mutually facing, inner surfaces of each of said arms, which arms are adapted to splay apart resiliently during the fitting and the removal of said clip onto and from, said water spray nozzle, with each of said arms provided with a mutually inclined surface to aid fitting, with the distance between inner ends of said inclined surfaces, in a non-splayed condition, being less than the diameter of said "C"-shaped recess and with a portion of said slot defining a clip retraction surface, said nozzle comprising a spigot portion of diameter approximating to that of said receiving bore; a water conveying passage extending through said spigot portion from an open, inlet end of said nozzle; a first circumferential groove located adjacent said water inlet end of said spigot portion to carry a resilient sealing ring to sealingly engage a portion of said receiving bore; said waist portion defined by a second circumferential groove located downstream of said first circumferential groove and adapted, in use, to be engageable by said clip; a head portion of said nozzle located downstream of said waist and intended, in use, to be external to said receiving bore; and a water discharge aperture provided in said head portion; and a housing comprising at least one flat to be engaged by a nozzle flat(s), and an aperture to receive said clip, said aperture providing an abutment surface adapted to be engaged by a portion of a surface of said clip when pushed into its aperture and engaging said second circumferential groove of said nozzle, which engagement prevents inadvertent nozzle removal, wherein said spigot receiving bore is provided with a frusto-conical mouth, adapted to be engaged by a frusto-conical sealing surface of the nozzle at a transition portion between said spigot and said head of said nozzle.

* * * * *